United States Patent [19]

Tsuji et al.

[11] Patent Number: 4,646,791

[45] Date of Patent: Mar. 3, 1987

[54] METHOD AND APPARATUS FOR INSERTING WEFT THREADS IN MULTIPLE-COLOR AIR JET LOOMS

[75] Inventors: Kanji Tsuji; Yasuyuki Tamatani; Takashi Senoo, all of Kanazawa, Japan

[73] Assignee: Tsudakoma Corporation, Ishikawa, Japan

[21] Appl. No.: 568,851

[22] Filed: Jan. 6, 1984

[30] Foreign Application Priority Data

Jan. 13, 1983 [JP] Japan ..... 58-004042
Jan. 13, 1983 [JP] Japan ..... 58-003188[U]

[51] Int. Cl.[4] ..... D03D 47/30
[52] U.S. Cl. ..... 139/435
[58] Field of Search ..... 139/435; 226/97

[56] References Cited

U.S. PATENT DOCUMENTS

| | | | |
|---|---|---|---|
| 3,818,952 | 6/1974 | Vermeulen | 139/435 |
| 4,020,877 | 5/1977 | Spisiak | 139/435 |
| 4,143,682 | 3/1979 | Jansa et al. | 139/435 |
| 4,326,565 | 4/1982 | Van Mullekom | 139/435 |
| 4,410,016 | 10/1983 | Manders | 139/435 |
| 4,448,222 | 5/1984 | Arakawa | 139/435 |
| 4,450,876 | 5/1984 | Van Mullekom | 139/435 |
| 4,534,387 | 8/1985 | Van Hest | 139/435 |

FOREIGN PATENT DOCUMENTS

| | | | |
|---|---|---|---|
| 2918182 | 11/1980 | Fed. Rep. of Germany | 139/435 |
| 3300934 | 7/1983 | Fed. Rep. of Germany | 139/435 |
| 2027945 | 8/1979 | United Kingdom | 139/435 |

*Primary Examiner*—Werner H. Schroeder
*Assistant Examiner*—Joseph S. Machuga
*Attorney, Agent, or Firm*—Flynn, Thiel, Boutell & Tanis

[57] ABSTRACT

Multiple-color air jet looms successively insert different kinds of weft threads into warp sheds to weave a fabric of desired construction. The different weft threads are subjected to different resistances to their being drawn through a main nozzle and are carried on air jets under different conditions, so that the weft threads will be inserted unstably at different speeds. With the arrangement of the invention, selected weft threads for insertion are carried, one at a time, through the warp shed under respective different weft carrying forces suited for the weft threads. The different weft carrying forces may be produced by varying pressures at which air is ejected, intervals of time during which air is ejected under pressure, or the manner in which subnozzles are positioned along the warp shed. There is provided a control means for changing the air pressures and ejection time intervals in synchronism with operation of the air jet loom.

11 Claims, 8 Drawing Figures

METHOD AND APPARATUS FOR INSERTING WEFT THREADS IN MULTIPLE-COLOR AIR JET LOOMS

FIELD OF THE INVENTION

The present invention relates to weft insertion in a multiple-color air jet loom, and more particularly to a method of and an apparatus for inserting a selected weft thread with a weft carrying force appropriate for the selected weft thread.

BACKGROUND OF THE INVENTION

Multiple-color air jet looms have a plurality of different kinds of weft threads in readiness for weft insertion and successively insert them, one at a time, through warp sheds according to a fabric to be woven on the loom. Such different weft threads typically vary in thickness. They are subjected to slightly different resistances to being drawn for weft insertion and are slightly differently carried on jets of air.

In prior multiple-color air jet looms, however, air under uniform pressure is ejected from groups of main nozzles and subnozzles irrespectively of the kind of selected weft thread to be inserted. This means that the weft carrying force remains constant at all times for different weft threads, and that the speed at which the weft threads are taken through the warp sheds varies from one weft type to another. For alternately inserting thin and thick weft threads, for instance, the pressure of air jets is preselected and fixed to meet the thick weft thread which requires a greater weft carrying force. Therefore, a certain amount of air under pressure is wasted when inserting the thinner weft threads.

SUMMARY OF THE INVENTION

It is an object of the present invention to provide a method and an apparatus for inserting different weft threads in and through warp sheds in a multiple-color air jet loom, in which air under pressure is ejected from a main nozzle unit or a main nozzle unit and subnozzles to produce different weft carrying forces suited respectively for the different weft threads for thereby carrying the weft threads, one at a time, through the warp shed at the same speed under stable conditions and preventing undue consumption of pressurized air.

According to the present invention, the foregoing object can be achieved by ejecting the air from the main nozzle unit or the main nozzle unit and subnozzles under different pressures preset respectively to produce the weft carrying forces for carrying the weft threads, or supplying air under pressure from the main nozzle unit or the main nozzle unit and subnozzles for different intervals of time selected respectively for the weft threads to produce the weft carrying forces. To eject the air under different pressures, the subnozzles are divided into groups along the warp shed and spaced at different intervals for the groups to produce combined air streams of varying pressures, or an air pressure control means is connected between a source of air under pressure and the main nozzle and subnozzles for supplying the air under different pressures to the main nozzle and subnozzles. To eject the air under pressure for different intervals of time, a valve means is connected between the source of air under pressure and the main nozzle and subnozzles, and a control means is actuated in synchronism with operation of the air jet loom for opening the valve means selectively for the intervals of time. With this arrangement, the weft threads can be inserted and carried through the warp shed under stable conditions in a constant period of time, and undue consumption of air under pressure is avoided.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
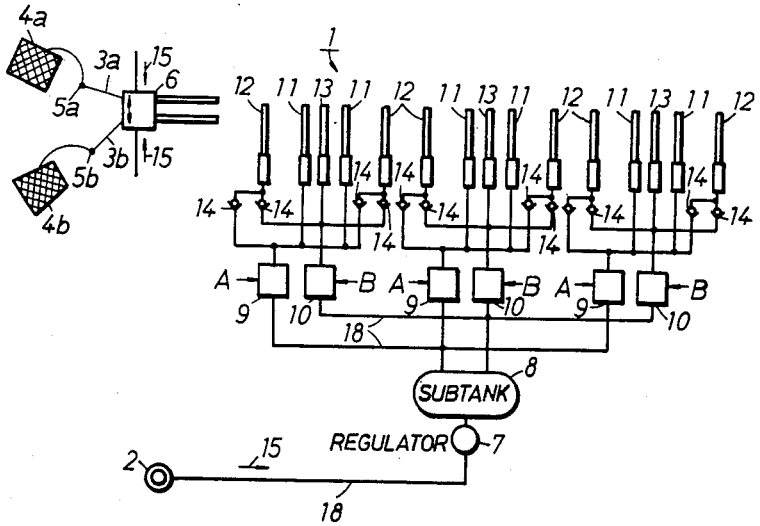
FIG. 1 is a schematic view of a pneumatic piping system in a weft insertion apparatus according to a first embodiment of the present invention.

Like or corresponding parts are denoted by like or corresponding reference characters throughout several views.

1st embodiment (FIG. 1):

FIG. 1 shows a pneumatic piping system in a weft insertion apparatus 1 according to a first embodiment of the present invention, the pneumatic piping system including subnozzles divided into different groups for producing different additional weft carrying forces to be applied in warp sheds. The weft insertion apparatus 1 shown is incorporated in an air jet loom in which two different weft threads are employed for insertion. The weft insertion apparatus 1 includes a source 2 of air under pressure for inserting the weft threads. The source 2 is connected through a pipe 18 to a regulator 7 and a subtank 8 which is coupled through a plurality, three for example, of on-off valves 9 to dedicated subnozzles 11 and common subnozzles 12 which constitute a subnozzle group I, and also through a plurality, three for example, of on-off valves 10 to the common subnozzles 12 and dedicated subnozzles 13 which constitute a subnozzle group II. The on-off valves 9, 10 are connected to the common subnozzles 12 through check valves 14.

A main nozzle unit 6 is positioned alongside of a warp shed and composed of two main nozzles respectively for two different weft threads 3*a*, 3*b*, the weft thread 3*a* being thicker than the weft thread 3*b*, for example. The main nozzle assembly 6 is movable to one, at a time, of two selected positions dependent on a selected one of the weft threads 3*a*, 3*b* for inserting the selected weft thread through the warp shed. The weft threads 3*a*, 3*b* are unreeled from weft supplies 4*a*, 4*b*, respectively, and supplied through yarn guides 5*a*, 5*b* to the main nozzle unit 6 by a weft thread storage unit and a weft thread selector (both not shown) according to the weft insertion sequence dictated by a fabric to be woven on the air jet loom.

The subnozzles 11, 12, 13 are arranged along the warp shed. The subnozzles 11, 12, which constitute the subnozzle group I, are spaced at intervals or pitches smaller than those at which the subnozzles 12, 13 constituting the subnozzle group II are spaced. These subnozzles 11, 12, 13 are individually capable of producing the same weft carrying force. Accordingly, provided the on-off valves 9, 10 remain open for the same interval of time for air supply, the subnozzle group I can produce a larger weft carrying force than that the subnozzle group II can produce.

Operation of the weft insertion apparatus thus constructed is as follows: The source 2 supplies air 15 to the subtank 8 under a low pressure determined by the regulator 7. Upon weft insertion, either the on-off valves 9 or the on-off valves 10 are opened for a prescribed period of time to allow passage therethrough of the air 15 under a reduced pressure toward the corresponding subnozzles 11, 12 or subnozzles 12, 13. The on-off valves 9, 10 are controlled by weft selection signals A, B supplied from a control unit. When the thicker weft thread 3*a* is to be inserted by the main nozzle unit 6, a larger weft carrying force is required. Therefore, the on-off valves 9 are opened by the weft selection signal A to pass the air 15 under a pressure appropriate for the thicker weft thread 3*a*, whereupon the subnozzles 11, 12 in the subnozzle group I eject the pressurized air 15 to produce a combined stronger air stream necessary for carrying the thicker weft thread 3*a*. For inserting the thinner weft thread 3*b* from the main nozzle unit 6, the on-off valves 10 are opened by the weft selection signal B to enable the subnozzles 12, 13 to emit the air 15 under a pressure sufficient to produce a combined weaker air stream necessary to carry the thinner weft thread 3*b*. Therefore, the subnozzles 11, 12, 13 are selectively operated dependent on the weft thread 3*a* or 3*b* to be inserted for carrying the selected weft thread with a weft carrying force suitable for that weft thread.

The different weft carrying forces may be produced not only by the differently spaced subnozzle groups I, II, but also by positioning one of the subnozzle groups I, II more remotely from the warp shed than the other group, changing the effective cross-sectional area of each nozzle orifice in one of the subnozzle groups I, II, supplying air under different pressures to the subnozzle groups I, II, ejecting air streams from the subnozzle groups I, II at different angles to the warp shed, or varying the intervals of time in which air is ejected from the subnozzle groups I, II.

The weft carrying forces, which are described in each embodiment, may be produced by varying the interval of time in which air is ejected or by varying air ejecting forces. The air ejecting forces are produced by a selective combination of different pitches of subnozzles, different effective cross-sectional areas of nozzle orifices of the subnozzles, different distances of the nozzles from the warp shed, different angles at which the subnozzles are directed to the warp shed, and different pressure under which air is supplied to the subnozzles.

The on-off valves 9, 10 may be selectively actuated by a mechanical cam device operable in synchronism with the rotation of a main shaft of the loom. For example, for selectively inserting two thicker weft threads of cotton and one strong thinner weft thread for weaving corduroy, such a mechanical cam device may comprise a control cam mounted on a valve control shaft which makes one third of a full rotation thereof when the main shaft of the loom makes one complete revolution, so that the subnozzles 11, 12 will be actuated for inserting one of the thicker weft threads and the subnozzles 12, 13 will be actuated for inserting the thinner weft thread.

With the foregoing arrangement, various kinds of weft threads can be stably inserted through warp sheds since weft carrying forces are available which are suited for the respective different weft threads. When inserting thinner weft threads that can be taken through warp sheds with small forces, the air 15 under pressure is effectively utilized without wastefull consumption.

Figure 2:
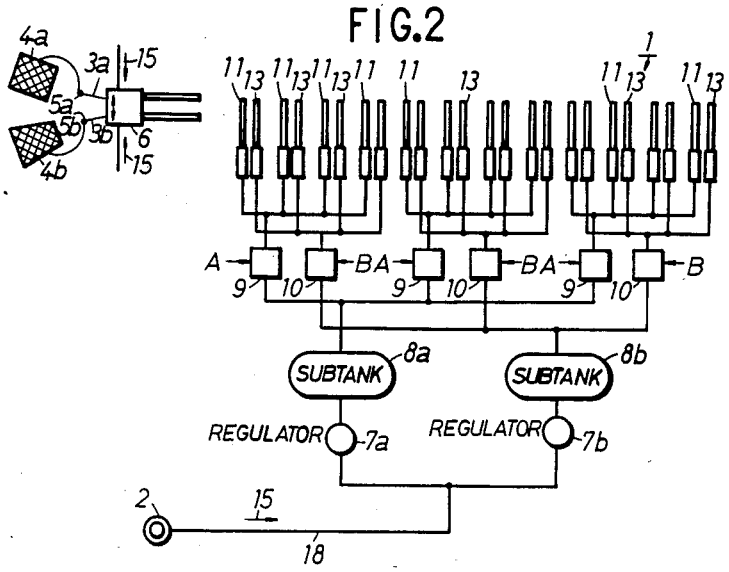
FIG. 2 is a schematic view of a pneumatic piping system in a weft insertion apparatus according to a second embodiment of the present invention.

2nd embodiment (FIG. 2):

According to the embodiment shown in FIG. 2, different weft carrying forces are produced in warp sheds by providing subnozzles having different orifice diameters or supplying air under different pressures to the subnozzles. There are no common nozzles such as those shown at 12 in FIG. 1, and pairs of subnozzles 11, 13 are arrayed at equal intervals or pitches, the subnozzles 11 or 13 being spaced at equal intervals. The groups of subnozzles 11, 13 are capable of producing different weft carrying forces. More specifically, the subnozzles 11 have nozzle orifices of an effective cross-sectional area larger than that of the nozzle orifices of the subnozzles 13. Provided the air 15 is supplied under the same pressure to the subnozzles 11, 13, therefore, the subnozzles 11 can exert a greater weft carrying force than the subnozzles 13. The weft insertion apparatus also includes a pair of regulators 7*a*, 7*b* and a pair of subtanks 8*a*, 8*b* connected respectively thereto. The subtank 8*a* is connected through the on-off valves 9 to the subnozzles 11, while the subtank 8*b* is connected through the on-off valves 10 to the subnozzles 13. One of the regulators, 7*a* for example, has a greater pressure setting than that of the other regulator 7*b*. As a consequence, the subtanks 8*a*, 8*b* supply the air 15 under different pressures to the corresponding subnozzles 11, 13 for regulating the weft carrying forces produced by the subnozzles 11, 13.

Figure 3:
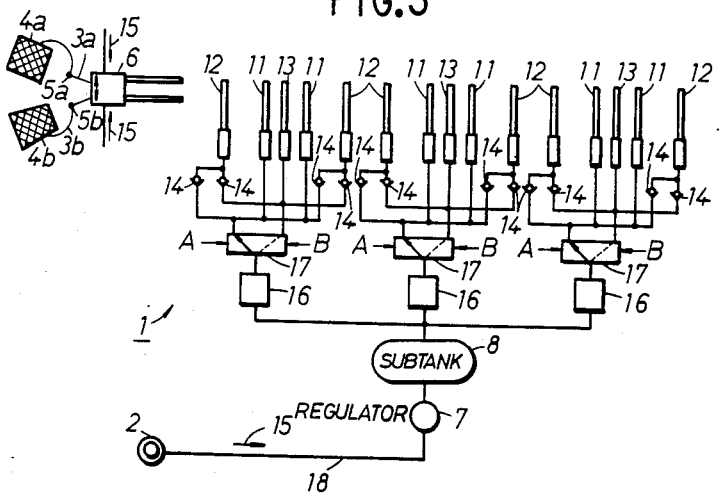
FIG. 3 is a schematic view of a pneumatic piping system in a weft insertion apparatus according to a third embodiment of the present invention.

3rd embodiment (FIG. 3):

The weft insertion apparatus shown in FIG. 3 has groups of subnozzles 11, 12, 13 that are arranged in a pattern identical to that of the subnozzles 11, 12, 13 shown in FIG. 1. The subtank 8 is connected to three on-off valves 16 which are respectively coupled to directional control valves 17, which in turn are selectably connectable to the subnozzle groups I, II. The on-off valves 16 are of the mechanical type and openable and closable for each pick. The directional control valves 17 are actuatable by the weft selection signals A, B to supply the air 15 under pressure through different paths selectively to the subnozzles 11, 12 or the subnozzles 12, 13.

4th embodiment (FIGS. 4 and 5):

According to the 4th embodiment, a weft inserting main nozzle 6 and weft carrying subnozzles 12 are selectively supplied with air 15 under different pressures.

Figure 4:
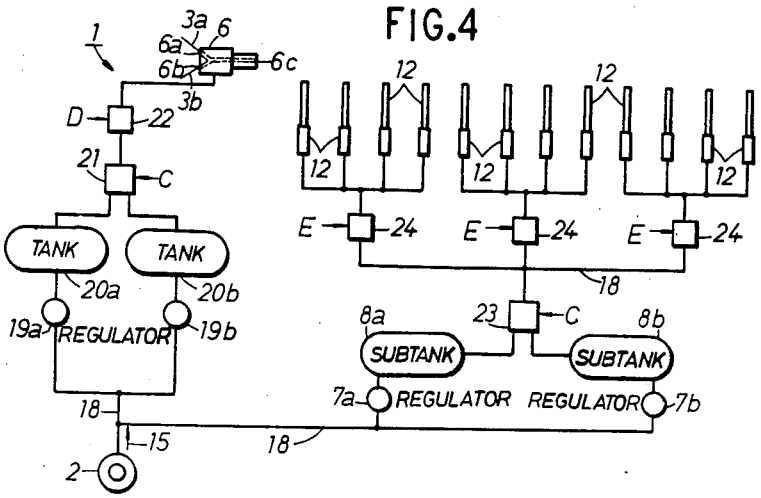
FIG. 4 is a schematic view of a pneumatic piping system in a weft insertion apparatus according to a fourth embodiment of the present invention.

FIG. 4 illustrates a pneumatic piping system for an air jet loom employing two different kinds of weft threads. A source 2 of pressurized air serves to supply air 15 under pressure for inserting and carrying weft threads, and is connected by a pipe 18 to a pair of regulators 19*a*, 19*b* and accumulator tanks 20*a*, 20*b*. The accumulator tanks 20*a*, 20*b* are coupled through a common directional control valve 21 and a common on-off valve 22 to the weft inserting main nozzle 6. The weft inserting main nozzle 6 has two weft passage holes 6*a*, 6*b* and a single common tube 6*c* connected thereto. A selected one of the weft threads 3*a*, 3*b* is fed through the weft passage hole 6*a* or 6*b* and the common tube 6*c* into the warp shed. The air source 2 is also connected through a pipe 18 to a pair of regulators 7*a*, 7*b* coupled respectively to a pair of subtanks 8*a*, 8*b*. The subtanks 8*a*, 8*b* are connected via a common direction control valve 23 to a plurality, three for example, of on-off valves 24 connected to the grouped subnozzles 12. The subnozzles 12 are arrayed along the warp shed for ejecting air 15 under a pressure appropriate for the weft thread being inserted through the warp shed to assist the weft thread in being carried through the warp shed. The directional control valves 21, 23 are controlled by a weft selection signal C, and the on-off valves 22, 24 are controlled by on-off command signals D, E, respectively.

Figure 5:
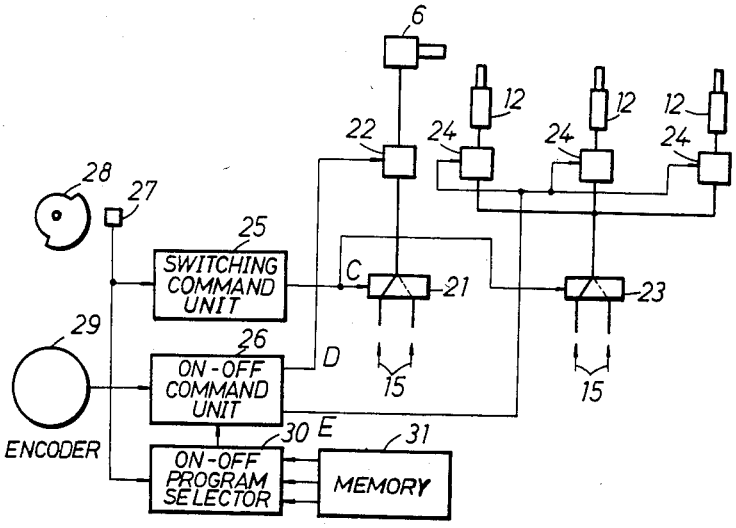
FIG. 5 is a block diagram of a control system for the weft insertion apparatus of the fourth embodiment.

FIG. 5 shows an electric signal generator for generating the weft selection signal C and the on-off command signals D, E. The weft selection signal C is issued by a control means comprising a switching command unit 25, and the on-off command signals D, E are issued by a control means comprising an on-off command unit 26. The switching command unit 25 is connected to a sensor 27 which detects rotation of a weft insertion control cam 28 for energizing the switching command unit 25 at a time prior to weft insertion. The weft insertion control cam 28 is rotatable in synchronism with the operation of the loom. In the illustrated embodiment, since the two weft threads are alternately inserted, the cam 28 makes half of a full revolution thereof when the main shaft of the loom makes a complete revolution. The on-off command unit 26 is energized by a signal supplied as input information from an encoder 29 which electrically reads angular displacement of the main shaft of the loom and delivers angle in formation to the on-off command unit 26. The sensor 27 is also connected to an on-off program selector 30 that is supplied with information indicative of a weft insertion timing angle from a memory 31 serving to set a weft insertion timing for delivering selected timing information to the on-off command unit 26. The regulators 7*a*, 7*b*, 19*a*, 19*b*, the accumulator tanks 20*a*, 20*b*, the subtanks 8*a*, 8*b*, the directional control valves 21, 23, and the on-off valves 22, 24 jointly constitute a means for controlling the air 15 under pressure.

Operation of the weft insertion apparatus shown in FIGS. 4 and 5 will now be described. The air 15 under pressure from the source 2 is supplied to the regulators 19*a*, 19*b* by which the air pressure is reduced to a suitable degree, and the reduced air pressure is stored in the accumulator tanks 20*a*, 20*b*. The pressure in the accumulator tank 20*a* is selected to be low for the insertion of the thinner weft thread 3*b*. The pressure in the accumulator tank 20*b* is selected to be higher than that in the accumulator tank 20*a* for the insertion of the thicker weft thread 3*a*. Likewise, the air 15 under pressure is fed through the regulators 7*a*, 7*b* by which the air pressure is reduced to the subtanks 8*a*, 8*b*, respectively. The pressure in the subtank 8*a* is lower than that in the subtank 8*b*.

While the main shaft of the loom makes one complete revolution, the cam 28 makes half of its full revolution so that the output signal from the sensor 27 will be varied each time the cam 28 rotates 180 degrees. Each time the cam 28 rotates 180 degrees or the loom main shaft makes one revolution, the switching command unit 25 varies the level of the weft selection signal C to shift the directional control valves 21, 23 for supplying air 15 under a different pressure to the on-off valves 22, 24. In response to the information from the sensor 27, the on-off program selector 30 reads a stored on-off program, that is, weft insertion timing program from the memory 31, to deliver a displacement angle with its timing corresponding to the selected weft thread to the on-off command unit 26. The on-off command unit 26 compares the weft insertion timing angle as read from the memory 31 with an actual displacement angle of the loom shaft as detected by the encoder 29. When the compared angles coincide with each other, the on-off command unit 26 issues the on-off command signals D, E to the on-off valves 22, 24, respectively. The on-off valves 22, 24 are then opened to allow the air 15 under pressure to pass therethrough to the main nozzle 6 and the subnozzles 12 in timed relation to weft inserting and carrying operations.

Where the thicker weft thread 3*a* is to be inserted, the weft insertion main nozzle 6 ejects the air 15 under a higher pressure to force the weft thread 3*a* into the warp shed, and where the thinner weft thread 3*b* is to be inserted, the weft insertion main nozzle 6 ejects the air 15 under a lower pressure to drive the weft thread 3*b* into the warp shed. The subnozzles 12 eject the air 15 under a pressure selected to meet the selected weft thread for accelerating and carrying the weft thread through the warp shed with a suitable weft carrying force.

The weft carrying force may be regulated by varying the interval of time in which the air 15 under pressure is ejected. For example, the on-off command unit 26 generates the on-off command signals D, E for a longer interval of time when the thicker weft thread 3*a* is to be inserted, and generates the on-off command signals D, E for a shorter interval of time when the thinner weft thread 3*b* is to be inserted. The on-off valves 22, 24 are therefore open for different intervals of time dependent on the kind of weft thread to be inserted, for thereby exerting an appropriate weft carrying force to the selected weft thread.

With the embodiment shown in FIGS. 4 and 5, the nozzles are supplied with air having a pressure suitable for a weft thread to be inserted. Where a weft thread is to be inserted which requires no larger weft carrying force, no undue consumption of pressurized air is assured for reduced total air consumption under pressure. Furthermore, since the nozzles for inserting and carrying weft threads are supplied with pressurized air at suitable ejection timings for the selected weft threads, respectively, the occurrence of weft insertion failures becomes less frequent, resulting in stabilized weft insertion.

Figure 6:
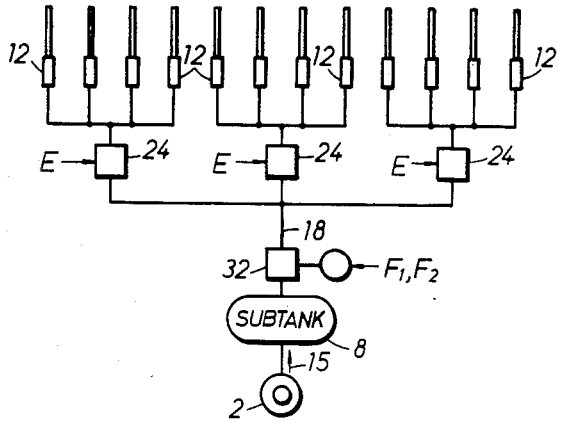
FIG. 6 is a schematic view of a pneumatic piping system in a weft insertion apparatus according to a fifth embodiment of the present invention.

5th embodiment (FIG. 6):

According to the embodiment of FIG. 6, air pressure is regulated by a single remotely controlled pressure regulator valve 32 disposed in a pipe 18 connecting a subtank 8 to a plurality, three for example, of on-off valves 24. The pressure regulator valve 32 is responsive to switching command signals F1, F2, applied one at a time, for passing air 15 under a pressure appropriate for the kind of a weft thread selected for insertion. The arrangement of FIG. 6 is simpler because there are required no separate subtanks for respective air pressure settings. Although only the remotely controlled pressure regulator valve 32 for the subnozzles 12 is shown in FIG. 6, a similar pressure regulator valve may be provided in a piping system for the main nozzle 6 for weft insertion.

Figure 7:
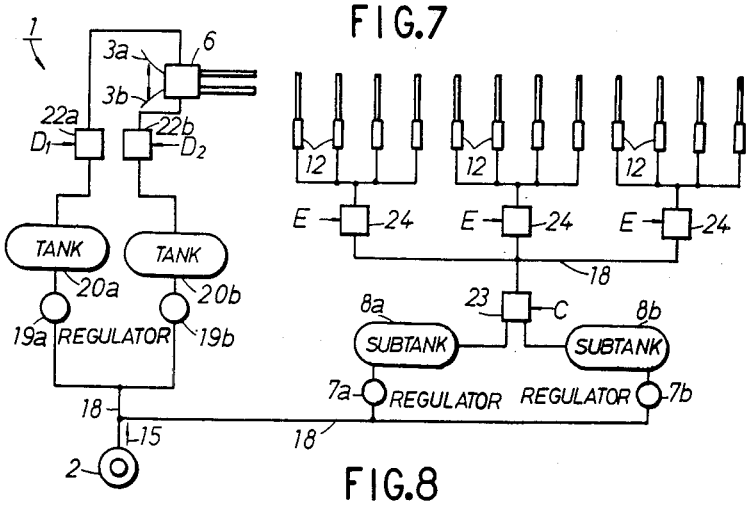
FIG. 7 is a schematic view of a pneumatic piping system in a weft insertion apparatus according to a seventh embodiment of the present invention.

6th embodiment (FIGS. 7 and 8):

As shown in FIG. 7, a main nozzle unit 6 is composed of a pair of main nozzles. Air 15 is supplied from tanks 20*a*, 20*b* under different pressures to the main nozzle unit 6 under the control of respective on-off valves 22*a*, 22*b*. The pressurized air 15 is selectively fed to the main nozzle unit 6 dependent on the kind of a weft thread to be inserted, so that the main nozzle unit 6 will be shifted in position to bring one of the main nozzles into alignment with the warp shed for inserting the selected weft thread.

Figure 8:
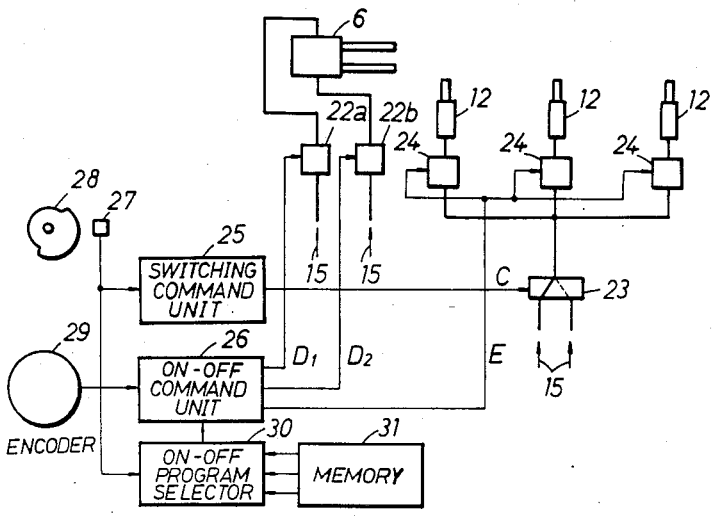
FIG. 8 is a block diagram of a control system for the weft insertion apparatus of the sixth embodiment.

FIG. 8 shows an electric control system in which the on-off valves 22*a*, 22*b* are controlled respectively by two on-off command signals D1, D2 alternately issued by an on-off command unit 26 in synchronism with weft thread selection.

Although the air jet loom employing two different weft threads has been described in each embodiment, the present invention is applicable to air jet looms using more than two different weft threads. The subnozzles and the piping system connected thereto in the 1st through 3rd embodiments may replace the subnozzles and the piping system connected thereto in the 4th and 6th embodiments. Furthermore, the main nozzle and the piping system coupled thereto with the control system therefor in the 4th and 6th embodiments may be incorporated in a multiple-color air jet loom having no subnozzles. In the illustrated embodiments, pressurized air is ejected at the same time from the subnozzles, but it may alternatively be ejected sequentially from the successive groups of subnozzles.

Although certain preferred embodiments have been shown and described, it should be understood that many changes and modifications may be made therein without departing from the scope of the appended claims.

What is claimed is:

1. An apparatus for selectively inserting one of different weft threads through a warp shed in a multiple-color air jet loom, comprising:

a source of air under pressure;

a plurality of main nozzles connected to said source and disposed alongside of the warp shed for ejecting air under pressure so as to insert the selected weft thread into the warp shed;

a plurality of subnozzles provided along the warp shed and connected to said source for ejecting air under pressure so as to urge the inserted weft thread through the warp shed in a weft inserting direction;

pipes interconnecting said source and said main nozzles and subnozzles, including in said pipes between each main nozzles and said source an on-off valve and including in said pipes between each said subnozzle and said source an on-off valve;

air control means disposed in said pipes for causing compressed air ejected from said main nozzles and subnozzles to be at an appropriate pressure dependent on the selected weft thread and for supplying air at said appropriate pressure to said main nozzles and said subnozzles for an interval of time which varies in duration in dependence on the selected weft thread, said air control means including said on-off valves; and control means for issuing a control command to said air control means dependent on the selected weft thread;

wherein said control means includes an on-off command unit actuable in synchronism with operation of the air jet loom for selectively issuing on-off commands to said on-off valves indicative of different intervals of time during which air is to be supplied to said main nozzles and subnozzles, said different intervals of time being respectively dependent on said different weft threads.

2. An apparatus for selectively inserting one of different weft threads through a warp shed in a multiple-color air jet loom, comprising:

a source of air under pressure;

a plurality of main nozzles connected to said source and disposed alongside of the warp shed for ejecting air under pressure so as to insert the selected weft thread into the warp shed;

a plurality of subnozzles provided along the warp shed and connected to said source for ejecting air under pressure so as to urge the inserted weft thread through the warp shed in a weft inserting direction;

pipes interconnecting said source and said main nozzles and subnozzles, including in said pipes between each said main nozzle and said source an on-off valve and including in said pipes between each said subnozzle and said source an on-off valve;

air control means disposed in said pipes for causing compressed air ejected from said main nozzles and subnozzles to be at an appropriate pressure dependent on the selected weft thread and for supplying air at said appropriate pressure to said main nozzles and said subnozzles for an interval of time which varies in duration in dependence on the selected weft thread, said air control means including said on-off valves; and control means for issuing a control command to said air control means dependent on the selected weft thread;

wherein said subnozzles are grouped into at least two groups capable of producing different weft carrying forces, said groups of subnozzles being selectively actuable, one said group for each weft insertion, by said control means in dependence on the selected thread.

3. An apparatus according to claim 2, wherein one of said groups of subnozzles and another said group of subnozzles are positioned at different distances from the warp shed for producing said different weft carrying forces.

4. An apparatus according to claim 2, wherein one of said groups of subnozzles and another said group of subnozzles are directed at different angles to the warp shed for producing said different weft carrying forces.

5. An apparatus according to claim 2, wherein said different weft carrying forces are produced by a selective combination of different pitches of said subnozzles, different effective cross-sectional areas of nozzle orifices of said nozzles, different distances of said nozzles from the warp shed, different angles at which said nozzles are directed to the warp shed, different pressures under which air is supplied to the subnozzles, and different intervals of time during which air under pressure is supplied to said subnozzles.

6. An apparatus for selectively inserting one of plural different weft threads through a warp shed in an air jet loom, comprising:

a source of pressurized air;

a plurality of selectively actuable main nozzles disposed alongside the warp shed for ejecting pressurized air so as to insert the selected weft thread into the warp shed;

a plurality of subnozzles provided along the warp shed for ejecting pressurized air so as to urge the inserted weft thread through the warp shed in a weft inserting direction;

pipes interconnecting said source and said main nozzles and subnozzles;

air control means disposed in said pipes for causing pressurized air ejected from said main nozzles and subnozzles to effect different weft carrying forces in dependence on the selected weft thread, said air control means including in said pipes between each said main nozzle and said source an on-off valve and including in said pipes between each said subnozzle and said source an on-off valve; and control means for issuing a control command to said air control means in dependence on the selected weft thread;

wherein said subnozzles are grouped into at least two groups which respectively produce said different weft carrying forces, said subnozzles in each said group being arranged in a prescribed order along the weft shed and being selectively actuable by said control means in dependence on the selected weft thread, on said group being actuated for each weft insertion; and wherein said subnozzles in the respective groups are spaced at different intervals along the warp shed for producing said different weft carrying forces.

7. An apparatus for selectively inserting one of plural different weft threads through a warp shed in an air jet loom, comprising:

a source of pressurized air;

a plurality of selectively actuable main nozzles disposed alongside the warp shed for ejecting pressurized air so as to insert the selected weft thread into the warp shed;

a plurality of subnozzles provided along the warp shed for ejecting pressurized air so as to urge the inserted weft thread through the warp shed in a weft inserting direction;

pipes interconnecting said source and said main nozzles and subnozzles;

air control means disposed in said pipes for causing pressurized air ejected from said main nozzles and subnozzles to effect different weft carrying forces in dependence on the selected weft thread, said air control means including in said pipes between each said main nozzle and said source an on-off valve and including in said pipes between each said subnozzle and said source an on-off valve; and control means for issuing a control command to said air control means in dependence on the selected weft thread;

wherein said subnozzles are grouped into at least two groups which respectively produce said different weft carrying forces, said subnozzles in each said group being arranged in a prescribed order along the weft shed and being selectively actuable by said control means in dependence on the selected weft thread, one said group being actuated for each weft insertion; and wehrein said subnozzles in the respective groups have nozzle orifices of different effective cross-sectional areas for producing said different weft carrying forces.

8. An apparatus for selectively inserting one of plural different weft threads through a warp shed in an air jet loom, comprising:

a source of pressurized air;

a plurality of selectively actuable main nozzles disposed alongside the warp shed for ejecting presurized air so as to insert the selected weft thread into the warp shed;

a plurality of subnozzles provided along the warp shed for ejecting pressurized air so as to urge the inserted weft thread through the warp shed in a weft inserting direction;

pipes interconnnecting said source and said main nozzles and subnozzles;

air control means disposed in said pipes for causing pressurized air ejected from said main nozzles and subnozzles to effect different weft carrying forces in dependence on the selected weft thread, said air control means including in said pipes between each said main nozzle and said source an on-off valve and including in said pipes between each said subnozzle and said source an on-off valve; and control means for issuing a control command to said air control means in dependence on the selected weft thread;

wherein said subnozzles are grouped into at least two groups which respectively produce said different weft carrying forces, said subnozzles in each said group being arranged in a prescribed order along the weft shed and being selectively actuable by said control means in dependence on the selected weft thread, one said group being actuated for each weft insertion; and wherein one of said groups of subnozzles and another said group of subnozzles are positioned at different distances from the warp shed for producing said different weft carrying forces.

9. An apparatus for selectively inserting one of plural different weft threads through a warp shed in an air jet loom, comprising:

a source of pressurized air;

a plurality of selectively actuable main nozzles disposed alongside the warp shed for ejecting pressurized air so as to insert the selected weft thread into the warp shed;

a plurality of subnozzles provided along the warp shed for ejecting pressurized air so as to urge the inserted weft thread through the warp shed in a weft inserting direction;

pipes interconnecting said source and said main nozzles and subnozzles;

air control means disposed in said pipes for causing pressurized air ejected from said main nozzles and subnozzles to effect different weft carrying forces in dependence on the selected weft thread, said air control means including in said pipes between each said main nozzle and said source an on-off valve and including in said pipes between each said subnozzle and said source an on-off valve; and control means for issuing a control command to said air control means in dependence on the selected weft thread;

wherein said subnozzles are grouped into at least two groups which respectively produce said different weft carrying forces, said subnozzles in each said group being arranged in a prescribed order along the weft shed and being selectively actuable by said control means in dependence on the selected weft thread, one said group being actuated for each weft insertion; and wherein one of said groups of subnozzles and another said group of subnozzles are directed at different angles to the warp shed for producing said different weft carrying forces.

10. An apparatus for selectively inserting one of plural different weft threads through a warp shed in an air jet loom, comprising:

a source of pressurized air;

a plurality of selectively actuable main nozzles disposed alongside the warp shed for ejecting pressurized air so as to insert the selected weft thread into the warp shed;

a plurality of subnozzles provided along the warp shed for ejecting pressurized air so as to urge the inserted weft thread through the warp shed in a weft inserting direction;

pipes interconnecting said source and said main nozzles and subnozzles;

air control means disposed in said pipes for causing pressurized air ejected from said main nozzles and subnozzles to effect different weft carrying forces in dependence on the selected weft thread, said air control means including in said pipes between each said main nozzle and said source an on-off valve and including in said pipes between each said subnozzle and said source an on-off valve; and control means for issuing a control command to said air control means in dependence on the selected weft thread;

wherein said subnozzles are grouped into at least two groups which respectively produce said different weft carrying forces, said subnozzles in each said group being arranged in a prescribed order along the weft shed and being selectively actuable by said control means in dependence on the selected weft thread, one said group being actuated for each weft insertion; and wherein said different weft carrying forces are produced by a selective combination of different spacings of said subnozzles, different effective cross-sectional areas of nozzle orifices of said subnozzles, different distances of said subnozzles from the warp shed, different angles at which said subnozzles are directed with respect to the warp shed, different pressures under which air is supplied to said subnozzles, and intervals of time during which air under pressure is supplied to said subnozzles subnozzles, said interval of time being varied in dependence on the selected weft thread.

11. A method of selectively inserting one of different weft threads through a warp shed in an air jet loom having nozzle means for ejecting air under pressure along the warp shed to carry the weft thread through the warp shed and having plural subnozzles provided along the warp shed, comprising the steps of ejecting air from said nozzle means with a respective predetermined pressure and for a respective predetermined time interval corresponding to the selected weft thread and ejecting air from at least one of said subnozzles with a respective predetermined pressure and for a respective predetermined time interval corresponding to the selected weft thread, wherein each said time interval is varied in duration in dependence on the selected weft thread.

* * * * *